United States Patent [19]

Canning et al.

[11] Patent Number: 4,519,667

[45] Date of Patent: May 28, 1985

[54] ELECTRICAL CONNECTOR

[75] Inventors: Terry D. Canning, Marion; Francis E. Hovan, Cedar Rapids, both of Iowa

[73] Assignee: Rockwell International Corporation, El Segundo, Calif.

[21] Appl. No.: 375,787

[22] Filed: May 6, 1982

[51] Int. Cl.[3] ..... H01R 13/645

[52] U.S. Cl. ..... 339/186 M; 339/92 M; 339/126 R

[58] Field of Search ..... 339/125 R, 186 R, 186 M, 339/184 R, 184 M, 92 R, 92 M, 45 M, 74 R, 75 M, 126 R

[56] References Cited

U.S. PATENT DOCUMENTS

| | | | |
|---|---|---|---|
| 2,840,791 | 6/1958 | Page, Jr. | 339/92 |
| 2,871,457 | 1/1959 | Jenks et al. | 339/45 M X |
| 2,933,713 | 4/1960 | Jackson et al. | 339/92 M |
| 3,048,685 | 8/1962 | Mrenna et al. | 200/168 |
| 3,053,357 | 9/1962 | Stanger | 189/36 |
| 3,426,315 | 2/1969 | De Tar | 339/184 M X |
| 3,582,867 | 6/1971 | Thompson et al. | 339/92 M |
| 3,711,817 | 1/1973 | Carter et al. | 339/126 R X |
| 3,950,059 | 4/1976 | Anhalt et al. | 339/75 M |
| 4,075,444 | 2/1978 | Hollingsead et al. | 339/75 M X |
| 4,109,987 | 8/1978 | Bourdon | 339/75 M |
| 4,181,391 | 1/1980 | Kilsdonk | 339/92 M |

*Primary Examiner*—Desmond: Eugene F.
*Assistant Examiner*—Steven C. Bishop
*Attorney, Agent, or Firm*—Robert C. Mayes; Edward A. Gerlaugh; George A. Montanye

[57] ABSTRACT

In a system of rack-and-panel mounted electronic units an improved electrical connector having unitary, injection-molded plastic connector body elements; reconfigurable connector keying hardware assembled coaxially with and held in place by fasteners used to attach the connector elements to structural members.

1 Claim, 7 Drawing Figures

ELECTRICAL CONNECTOR

BACKGROUND OF THE INVENTION

The invention relates to electrical connectors, and more particularly, to multiconductor electrical connectors having a pair of mutually engageable elements which when brought together provide a plurality of electrical contacts. Such connectors are used to facilitate connection and disconnection of electronic units in a system of panel or rack-mounted equipment. Modern aircraft, for example, are equipped with such racks affixed to the aircraft structure. The racks are adapted to receive and support electronic units or boxes such as computers, radios, navigation units, flight control units, etc. When servicing is required, a unit may be removed from the rack and replaced by another. The disconnection and removal of one unit and the insertion and connection of another, in order to be quickly and efficiently accomplished, requires a durable electrical connector having one element mounted on the rack and wired to the permanent aircraft wiring bus, and a second element mounted on the electronic unit or box and wired to the circuits contained in the unit. Each connector element carries a plurality of electrical terminals adapted to engage a corresponding plurality of electrical terminals on the other element of the connector, when the elements are joined.

Prior art connector elements comprised a metal shell or frame inside which was bonded a plastic housing holding the electrical contacts. Prior to assembly, the metal shell required machining operations to provide tapped holes or holes receiving threaded inserts for fastening the connector element to a unit or to a rack assembly. The number of manufacturing operations, i.e., machining, assembly and loading, was labor-intensive and costly. Further, accumulation of tolerances during the multiple manufacturing and assembly steps limited control over the position of the electrical contacts held in the plastic body of the connector element.

Many remotely mounted electronic units require more than one connector assembly to provide a sufficient number of electrical connections to the aircraft wiring bus. The precise alignment of multiple connector elements is difficult, and in the prior art was accomplished by installing the connector elements loosely in the rack assembly or electronic unit as applicable with fasteners finger-tight, installing the electronic unit in the rack assembly and mating the connector elements to normalize their position, and finally securely tightening the fasteners. This method is time-consuming, labor-intensive and complicated by limited access to the connector fastening elements, especially in cramped environments such as in aircraft.

Remotely mounted electronic units perform a wide variety of functions. Industry standardization, particularly in avionics, has limited the shape and dimensions of electronics units or "black boxes" to a few standard sizes. This allows standardization of many parts including components of the rack assembly such as mounting trays. Therefore, many different black boxes could be potentially installed in the same mounting tray. This requires that a keying system be provided which allows only a specific type of remotely mounted unit or black box to be mated with a particular connector element in a mounting tray. Prior-art connectors utilized keys and keyways of various shapes adhesively bonded into the connector body or attached to the connector shell with threaded fasteners. Adhesively bonded keying elements, if damaged, were difficult if not impossible to remove and replace, and keying systems utilizing threaded fasteners were expensive to manufacture and install.

It is, therefore, an object of the present invention to provide an improved electrical connector.

It is another object of the present invention to provide an improved rack-mounted connector assembly having unitary connector elements.

Still another object of the invention is to provide an improved electrical connector assembly for rack-mounted equipment having unitary connector elements formed of durable thermoplastic material.

Another object of our invention is to provide an improved electrical connector having a novel keying system which is simply and easily assembled integrally with the connector mounting hardware.

In accordance with the present invention, there is provided a multiconductor electrical connector having a pair of mutually engageable connector elements, each of the elements being a unitary body molded from thermoplastic material. The connector includes fastener means for attaching at least one of the connector elements to a fixed structure and coaxial with the fastening means, means for keying the connector elements to one another. In one embodiment of the invention, an insulating panel grips a plurality of electrical conductor terminal pins associated with one of the connector elements, the panel being fastenable to the connector element thus facilitating easy removal and replacement of the one connector element.

While the invention is set forth with particularlity in the appended claims, other objects, features, the organization and method of operation of the instant invention will become more apparent, and the invention will best be understood by referring to the following detailed description in conjunction with the accompanying drawings in which:

DESCRIPTION OF THE PREFERRED EMBODIMENT

Figure 1:
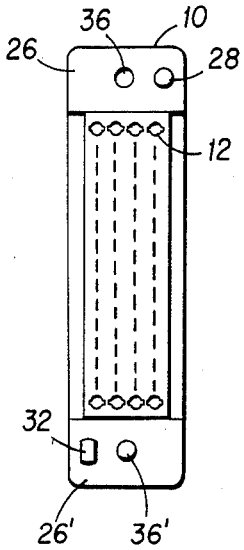
FIG.1 is an end-view of a connector element in accordance with the present invention.
Figure 2:
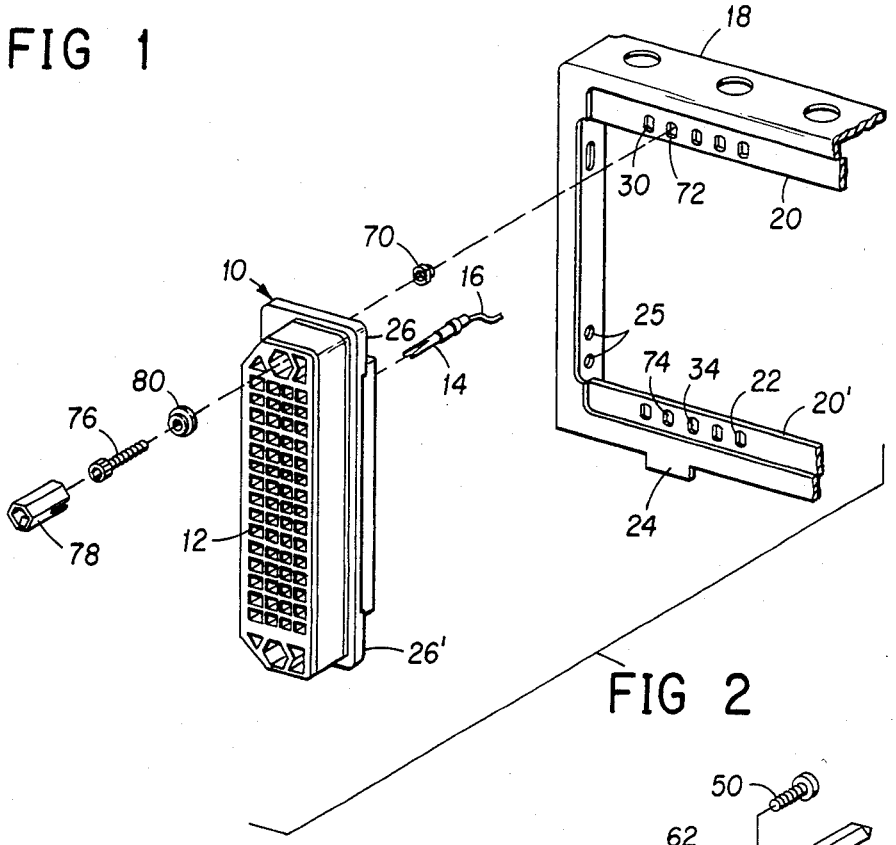
FIG. 2 is an exploded pictorial view of a connector element and associated components in accordance with the instant invention.
Figure 3:
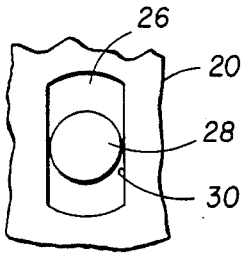
FIG. 3 is a detailed enlarged view of a portion of a connector mounted to the structural element in accordance with the invention.

Referring now to the various views of the drawing for a more detailed description of the construction, operation and other features of the invention by characters of reference, FIGS. 1 and 2 show a connector element 10 having a plurality of apertures 12 therethrough for receiving a corresponding plurality of connector sockets 14, only one of which is shown in FIG. 2. Individual wires such as a wire 16 are connected to the sockets 14 as by soldering or crimping, the sockets 14 being inserted into the apertures 12 in a manner well known in the art. The connector element 10 is of unitary construction, injection-molded from a thermoplastic material, the preferred material being 40% glass-filled polypheneylene sulfide (PPS). The one-piece connector element 10 eliminates the need for assembly and bonding of an insulating connector body inside a metal shell. The connector element 10 is affixed to a connector mounting plate 18. The mounting plate 18 is typically formed of sheet aluminum and is located at the rear of an equipment mounting tray (not shown). The mounting tray is securely attached to a rigid structure such as an equipment rack or some part of an aircraft structure. The mounting plate 18 includes upper and lower flanges, 20, 20$^1$. The location of the apertures 22 with respect to one another and collectively with respect to locating elements such as a tab 24 or mounting holes 25 is carefully controlled during manufacture of the mounting plate 18. Referring to FIG. 1, the connector element 10 includes mounting surfaces 26, 26$^1$ which abut the flanges 20, 20$^1$ of mounting plate 18. A locating dowel 28 formed in the connector element 10 protrudes from the upper mounting surface 26, and is insertable in the aperture 30 of flange 20 as shown in FIG. 3. FIG. 3 shows a typical one 30 of the plurality of apertures 22, as having an elongated "double-D" shape. The dowel 28 fits vertically (with reference to FIG. 3) loosely in the aperture 30, and horizontally snugly, thus controlling the horizontal location of the upper part of the connector element 10 in relation to the mounting plate 18. An elongated locating dowel 32 is formed on the lower mounting surface 26$^1$ for insertion into aperture 34 of the lower flange 20$^1$. The locating dowel 32 is double-D shaped to fit snugly into the aperture 34, thus providing horizontal positioning for the lower part of the connector element 10 and vertical positioning for the entire connector element 10 in relation to the mounting plate 18. Upper and lower apertures 36, 36$^1$ in the connector element 10 which are vertically on the same centers as the apertures 22 in the upper and lower flanges 20, 20$^1$ facilitate affixing the connector element 10 to the mounting plate 18 as will be described hereinafter. The electrical connector of the present invention thus provides molded-in features which locate the connector elements so accurately that they need not be mated to adjust the position of the connector elements on the black boxes and the mounting trays.

Figure 4:
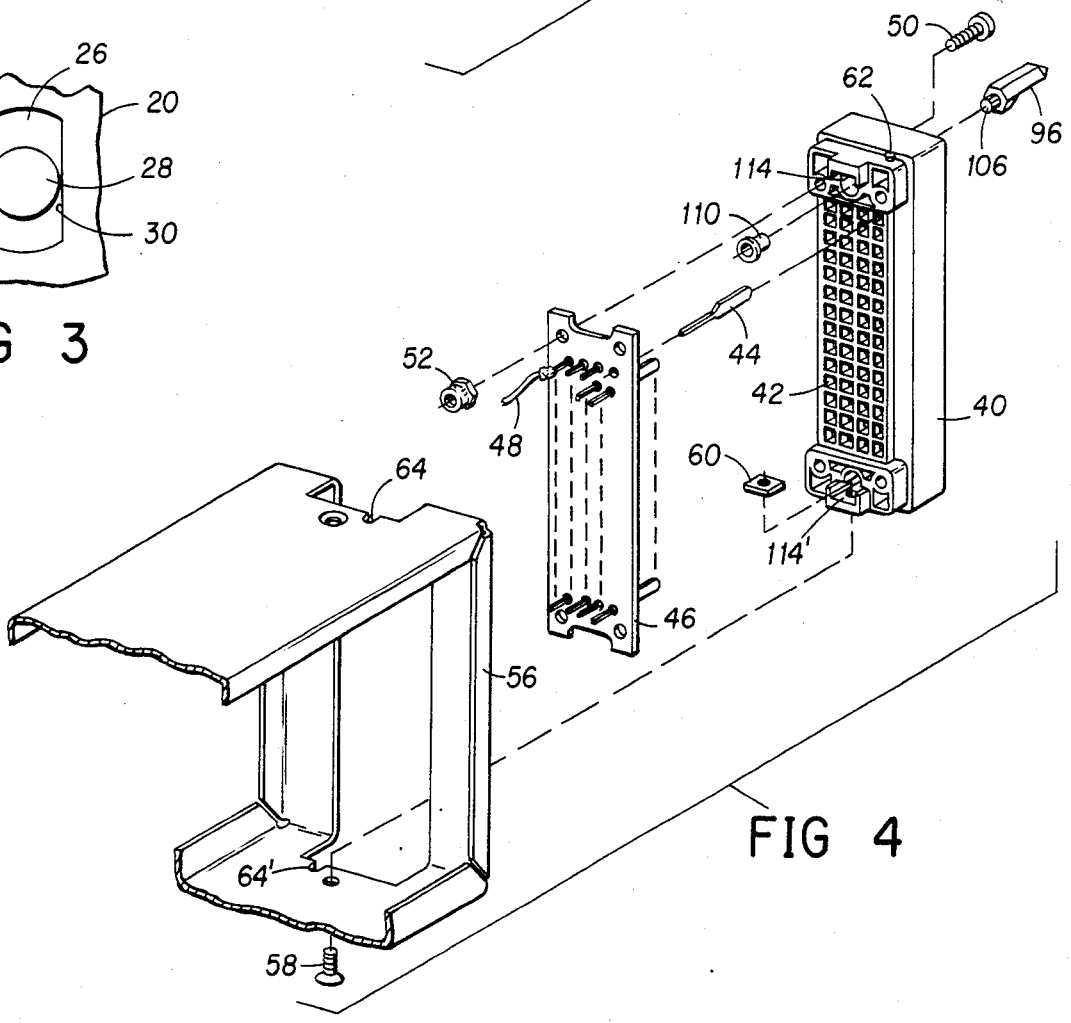
FIG. 4 is an exploded pictorial view of a unit connector element and its associated components in accordance with the present invention.

Referring now to FIG. 4, a unit connector element 40, mateable with the connector element 10 (FIG. 2), includes a plurality of apertures 42 each receiving one of a corresponding plurality of contact pins such as the pin 44. The plurality of contact pins 44 are conveniently carried on a panel 46 of insulative material which may be, for example, glass-epoxy. The pins 44 may be driven into the panel 46, and wiring assembled thereto as by soldering or wrapping as shown by representative wire 48. The panel 46 carrying the plurality of pins 44 may then be assembled to the connector element 40 and affixed thereto by any suitable fastening means such as the illustrated screw 50 and locknut 52. The unit connector element 40 may thus be removed and replaced easily if it is damaged. Referring momentarily to FIGS. 2 and 4, when the connector elements 10, 40 are mated, the plurality of connector sockets 14 each receives therein a corresponding one of the plurality of contact pins 44 of the connector element 40.

Referring again to FIG. 4, the unit connector element 40 is affixed to a chassis 56 of an electronic unnit by any suitable fastening means such as a screw 58 and nut 60. A pair of location tabs such as upper tab 62 are molded into the unit connector element 40. The locating tabs are insertable into a corresponding pair of grooves 64, 64$^1$ formed in the chassis 56 for accurately positioning the connector element 40 with respect to the chassis 56.

Figure 5:
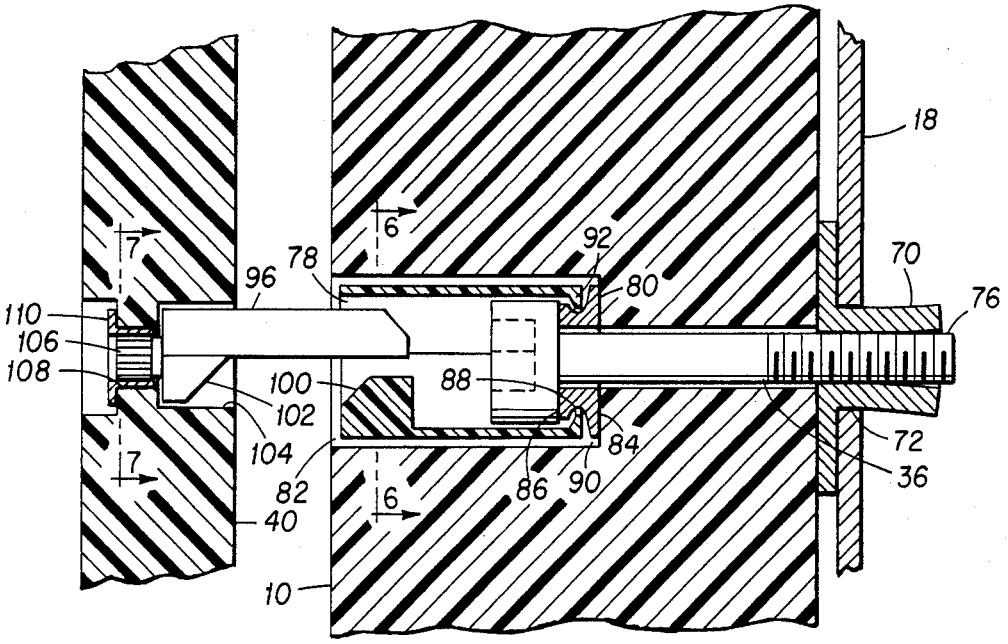
FIG. 5 is an enlarged, cut-away sectional view of a portion of a connector assembly illustrating the mounting and keying features of the instant invention.
Figure 6:
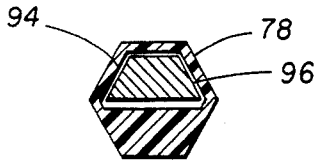
FIG. 6 is a modified sectional view taken along lines 6—6 of FIG. 5.
Figure 7:
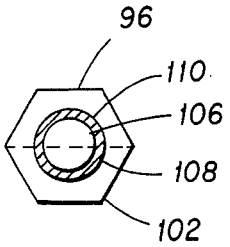
FIG. 7 is a modified sectional view taken along lines 7—7 of FIG. 5.

The connector keying system of the present invention is best described with reference to FIG. 5 in conjunction with FIGS. 2 and 4. A press-in nut 70 is installed in each one of two apertures 72, 74 in the mounting plate 18 which apertures are coincident with the desired vertical center line of the connector element 10. The nuts 70 are shaped to fit snugly into the double-D shaped apertures 72, 74 so that they lock into the plate and cannot turn. The nuts 70 are slotted so that slight compression is required to insert the nuts. A cap screw 76 threaded into the nut 70 is prevented from loosening by the pressure exerted thereon by the portion of the nut 70 protruding from the aperture 72. The cap screw 76 is inserted through a keyway 78 and a keyway retainer 80 into the aperture 36 of the connector element 10. The keyway 78 is an elongated receptacle having a hexagon-shaped cross-sectional area and formed from a durable plastic material such as polyamide. The keyway 78 fits snugly into a hexagon-shaped recess 82 molded into the connector element 10 as a coaxial extension of the aperture 36. The keyway retainer 80 which is generally annular in shape has two opposing flat surfaces 84, 86 and an annular recess or slot centrally disposed around the exterior periphery of the keyway retainer 80. The flat surface 84 of the keyway retainer 80 abuts an interior surface 90 at the end of the hexagon-shaped recess 82. The head of the cap screw 76 abuts the other flat surface 86 of the keyway retainer 80. A generally annular bead 92 adapted for insertion into the annular slot 88 of the keyway retainer 80 is formed at the interiorly disposed end of the keyway 78. Keying of the connector elements 10, 40 is facilitated by a half-hexagon-shaped opening 94 (see FIG. 6) in the keyway 78 which receives a half-hex metal keying pin 96 affixed to the unit connector 40. A beveled edge 100 of the keyway 78 opening guides the key 96 into the keyway 78. The metal keying pin 96 includes a hexagon-shaped base 102 insertable into a hexagonal aperture 104 molded in the unit connector element 40. The keying pin 96 includes a knurled knob 106 having a cross-sectional diameter smaller than that of the hex-shaped base 102 and extending therefrom into a centrally disposed aperture 108 formed in the connector element 40 as a coaxial extension of the aperture 104. The knob 106 is pressed into a bushing 110 inserted into the aperture 108 from the opposite side of the connector element 40 of the hex-shaped aperture 104.

The present invention greatly simplifies the assembly and mounting of the connectors and their associated keying systems. The keyway retainer 80 is slipped over the threaded portion of the socket-head cap screw 76, then snapped onto the bead 92 of the keyway 78. The keyway 78 is fabricated from a durable, high-impact and flexible plastic material which can take the abuse of connector mating and still be flexible enough to snap onto the keyway retainer 80. The preferred material is DuPont Zytel ST-801 NC-10 or the equivalent thereof. When the keyway 78/retainer 80/screw 76 assembly is completed, the assembly is inserted into the hex-shaped cavities such as the cavity 82 at the top and bottom ends of the connector element 10. The shank of the screw 76 passes through the reduced diameter aperture 36 in the base of the hex-shaped cavity 82 and threads into the press-in nut 70 inserted in the aperture 72 of the connector mounting plate 18. The screw 76 is tightened using a hex socket wrench, access to the screw-head being through the open, front end of the keyway 78. The keyway retainer 80 acts as a bearing surface under the screw-head and in concert with the tight fit of the keyway 78 in the hex cavity 82 retains the keyway 78 within the connector element 10. The keying pin 96 is not bonded in a hexagonal hole in the unit connector element as in the prior art; instead, it is positioned in the molded hex aperture 104, then the bushing 110 is pressed onto the knurled knob 106 of the pin 96 to secure it in the connector element 40. This mechanical approach to pin retention eliminates bonding and heat curing, and allows the establishment of connector keying configurations relatively late in the assembly process, thereby negating the need to maintain an inventory of pre-configured connectors. The keyway 78 provides the same positionable, half-hexagon receptacle to receive the keying pin 96 as provided in the prior art; however, the keyway of the present invention is unique in that it combined the keying function with that of connector element fastening. This merging of functions at a common location saves space within the connector element, reduces the number of apertures required in the connector body, and allows the keyway position to be altered easily, merely by unfastening the connector element mounting screw.

The present invention provides a novel means for attaching the unit connector element 40 to the equipment chassis 56. Referring to FIG. 4, it can be seen that the connector element 40 is secured to the chassis 56 at top and bottom by flat head screws such as the screw 58. Flat head screws are used so that no screw heads project from the top or bottom surfaces of the chassis, which surfaces are sliding surfaces. Normally, the use of flat head screws would affect the position of the connector element 40 due to the camming action of the screw head abutting the counter-sunk hole. Nut cavities 114, 114$^1$ are molded into the unit connector element 40 at either end thereof. The nut cavities 114, 114$^1$ are sized to accept a standard square machine nut such as the nut 60 and to position the nuts adjacent the mounting holes. The dimensions of the nut cavities 114, 114$^1$ are such that the nuts will float in all directions with the mounting screws, but are prevented from turning. This approach allows the connector to be properly located in the chassis 56 utilizing the molded-in tabs 62 and the corresponding chassis slots 64, 64$^1$, and then to be secured to the chassis without further movement, simply by tightening the fasteners. Further, no drilling, tapping, or inserts are needed for the connector, which is used in the as-molded state.

While the principles of the invention have now been made clear in the foregoing illustrative embodiments, there will be immediately obvious to those skilled in the art many modifications of structure, arrangement, proportions, the elements, material and components used in the practice of the invention, and otherwise, which are particularly adapted for specific environments and operating environments without departing from those principles. The appended claims are, therefore, intended to cover and embrace any such modifications, within the limits only of the true spirit and scope of the invention.

What is claimed is:

1. In a system of electrically interconnected electronic and electrical equipment including a first structural element comprising a rack assembly and a second structural element comprising a modular electronic unit supported by said rack assembly and removable therefrom, an electrical connector comprising:

a first electrical-connector element attachable to one of said structural elements;

a second electrical-connector element attachable to the other one of said structural elements, said second electrical-connector element being mutually engageable with said first electrical-connector element, each of said first and said second electrical-connector elements being a unitary body of molded plastic material carrying a plurality of electrical contacts electrically connecting the modular electronic unit into the system when said first and said second electrical connector elements are mutually engaged;

means for attaching said first electrical-connector element to its associated said structural element, said attaching means including a threaded nut pressed in said one structural element, and further including at least two double-D shaped apertures for alignment, and a threaded screw carried in said one electrical-connector element; and means for keying said first and said second electrical-connector elements whereby electrically compatible pairs of said first and said second electrical-connector elements are made mutually engageable and electrically non-compatible pairs of said first and said second electrical-connector elements are prevented by said keying means from being mutually engaged, said keying means including a keyway coaxial with said attaching means, the keyway being retained in said one electrical-connector element by the screw, said keying means including a key insertable in the keyway when said first and said second electrical-connector elements are mutually engaged, said key being attached to the other one of said first and said second electrical-connector elements.

* * * * *